United States Patent [19]

Glenn, III et al.

[11] 4,447,930

[45] May 15, 1984

[54] POWER HEAD UNIT FOR CARPET CLEANING

[75] Inventors: William K. Glenn, III, Anderson; John E. Jones, Greenville; Gordon E. Laing, Anderson; William R. Sumerau, Easley, all of S.C.

[73] Assignee: The Singer Company, Stamford, Conn.

[21] Appl. No.: 453,363

[22] Filed: Dec. 27, 1982

[51] Int. Cl.[3] ..... A47L 11/00

[52] U.S. Cl. ..... 15/322; 15/321; 15/377

[58] Field of Search ..... 15/320, 377, 321, 322

[56] References Cited

U.S. PATENT DOCUMENTS

| | | | |
|---|---|---|---|
| 1,596,041 | 8/1926 | Young | 15/320 |
| 2,384,458 | 9/1945 | Dubay | 15/320 |
| 3,289,240 | 2/1966 | Vanderveer et al. . | |
| 3,409,379 | 11/1968 | Vanderveer | 401/22 |
| 4,097,950 | 7/1978 | Satterfield | 15/49 R |
| 4,137,590 | 2/1979 | Brown | 15/50 R |
| 4,183,112 | 1/1980 | Brown et al. | 15/50 R |
| 4,240,569 | 12/1980 | Bessinger | 222/220 |
| 4,245,371 | 1/1981 | Satterfield | 15/320 |

*Primary Examiner*—Chris K. Moore

*Attorney, Agent, or Firm*—Edward P. Schmidt; Robert E. Smith; Edward L. Bell

[57] ABSTRACT

A power head unit for use with an external source of vacuum, which unit includes an outer housing defining a brush chamber, a vacuum chamber and a dry chemical carpet cleaning powder retaining chamber. The powder retaining chamber is fashioned with at least one slot extending adjacent the brush chamber which slot is closed off by a covering device such as a sliding door. The sliding door is fashioned with apertures the size of the at least one slot so that correspondence thereof will permit the dry chemical carpet cleaning material to escape from the slot. A powder dispensing roll is provided internally of the powder retaining chamber to convey the dry chemical carpet cleaning material to the slot. The power head device may be utilized in a vacuum mode of operation as a vacuum cleaner, or in a cleaning mode of operation as a carpet cleaner, in which latter mode provision may be made to separate the source of vacuum from the vacuum chamber so as to permit the dry chemical carpet cleaning powder to be thoroughly mixed in the rug fibers without removal thereof. The powder retaining chamber may be fashioned of translucent material and a light source situated adjacent the same so as to facilitate the determination of the quantity of powder remaining in the powder retaining chamber.

24 Claims, 13 Drawing Figures

POWER HEAD UNIT FOR CARPET CLEANING

BACKGROUND OF THE INVENTION

This invention relates to a floor care apparatus; more particularly, it relates to a power head device for storing and dispensing a dry chemical carpet cleaning material and agitating this material into the carpet fibers for dirt pick up and suspension prior to removal from the carpet by an external vacuum source.

For a period of years, there has been available a so-called dry chemical carpet cleaning material which may be dispensed over a soiled carpet, agitated in among the fibers to absorb and retain in pores of the material the soil and dirt released from the fibers. Instead of being dry, the material carries a cleaning agent which is brought into contact with the carpet fibers to release the soil therefrom. Thus, the material which may be called powder is not actually dry but may have a moisture content of approximately 40% which results in a moist coherent cleaning composition tending to agglomerate or pack together. In addition to the cleaning agent, the dry chemical carpet cleaning material further includes, for example, a synthetic polymer formulated into sponge like porous particles which retain dirt brought thereto by the cleaning agent from the carpet fibers.

To obtain effective cleaning, it is necessary that some form of agitation bring the material into contact with the carpet fibers. A great deal of effort has been expended in the commercial field to insure that proper agitation of the carpet cleaning material into the carpet fibers is achieved in order to obtain proper cleaning thereof. Some examples of the prior art in the commercial field are found in the U.S. Pat. Nos. 4,245,371; 4,183,112; 4,137,590 and 4,097,950 assigned to the Milliken Research Corporation; and 4,240,569 assigned to Clark-Gravely Corporation. Some earlier work has also been accomplished by Bissel Incorporated in developing a manual device for applying and working a dry cleaning material into a carpet. This latter prior art is found in U.S. Pat. Nos. 3,409,379 and 3,289,240. Thus, there has been substantial work in the commercial field in the agitation of a dry chemical cleaning material into carpet fibers, and into the removal of the same therefrom; as well as a manual device for use in the home market for dispensing and brushing a dry chemical carpet cleaning material into a carpet.

What is now proposed is a simple power head device approaching the efficiency of the commercial devices and having the capability to disseminate dry chemical carpet cleaning material or powder onto the carpet, thoroughly agitate the same into the carpet fibers and remove the same from the fibers by means of a separate vacuum source. Ideally, such device should have the capability for storing the material for a period of time without the loss of the cleaning agent. Still further, such device should be of compact construction and entirely suited for use in a home or apartment by the occupant thereof.

SUMMARY OF THE INVENTION

The above desired ends are attained in a power head device having means therein for retaining the dry chemical carpet cleaning material, or powder, and selectively dispensing the same, together with means for agitating the powder into the carpet fibers for cleaning thereof, and provision for removal of the dirt charged powder by external vacuum means. A power head is provided at the lower end of a wand preferably having controls at the upper end thereof and an orifice for connection to an external source of vacuum such as a canister or tank vacuum cleaner, convertible upright vacuum cleaner, or a built in home vacuum system. A power connection is provided for the power head supplying power to motor or motors contained therein for actuating a floor brush, a powder dispensing roll and dispensing device in the powder carrying chamber. The motor for powering the brush may revolve in one direction for vibrating and sweeping the powder agitated into the carpet, or dirt in the carpet during a vacuum mode of operation, into a vacuum chamber in the power head leading to the wand and the external source of vacuum. When revolved in the opposite direction, the floor brush may part the carpet fibers to permit the powder carpet cleaning material to be dropped deep into the carpet, and thereafter provide good agitation of the powder cleaning material in and among the carpet fibers. The powder dispensing roll may be driven through a one way clutch from a belt driving the floor brush so as to be actuated only during floor brush reversal for carpet cleaning; or, may be actuated through a separate motor which is activated only during a carpet cleaning mode of operation. The powder dispensing roll itself may be implemented by a polyurethane foam roller having open pores on its outside diameter which pick up the powder dry carpet cleaning material and transfer the same to slots in the bottom of the powder retaining cavity normally sealed from the powder by the roller. Alternatively, the powder dispensing roll may be fashioned as a multi-paddle device which transfers the powder material past slots in the hopper which may selectively be uncovered by a door member to allow the powder cleaning material to drop onto the carpet. The powder retaining cavity may be sealed to prevent loss of the cleaning agent so that the material may be retained for long storage periods without affecting its ability to release dirt from the carpet fibers to the pores in the solids therein. A light source may be provided behind the powder retaining cavity, which light source may be activated during the carpet cleaning mode of operation so that an operator might be made aware of the quantity of powder cleaning material remaining in the powder retaining cavity and visible through a translucent housing. An agitator rod in the powder retaining cavity is driven during operation in the cleaning mode to revolve within the powder retaining cavity to break up clumps of the powder carpet cleaning material which tends to agglomerate. The controls for the power head ideally include an ON-OFF switch, a vacuum mode selector, and a cleaning mode selector. A separate control is provided for release of the dry chemical carpet cleaning material onto the carpet fibers. Power for the power head may be obtained directly from house mains and power may be supplied to the external vacuum source from the power head. Alternatively, the power head unit and the external vacuum source may be separately powered. During the cleaning cycle, the vacuum source must be cut off to prevent removal of the cleaning composition while it is being worked into the carpet. This may be accomplished by turning off a separately activated vacuum source, or by providing a vacuum spoiling orifice in the wand, or by providing that the external vacuum source be powered through the power head so that controls therein cut off power to the external vacuum source during the cleaning cycle.

DESCRIPTION OF THE DRAWING

While the specification concludes with claims particularly pointing out and distinctly claiming the subject matter which is regarded as forming the present invention, it is believed that the invention will be better understood from the following detailed description when taken in conjunction with the annexed drawings which disclose, illustrate and show a preferred embodiment of modification of the present invention and what is presently considered and believed to be the best mode of practicing the principles thereof and wherein:

BRIEF DESCRIPTION

Figures 1, 2, 3:
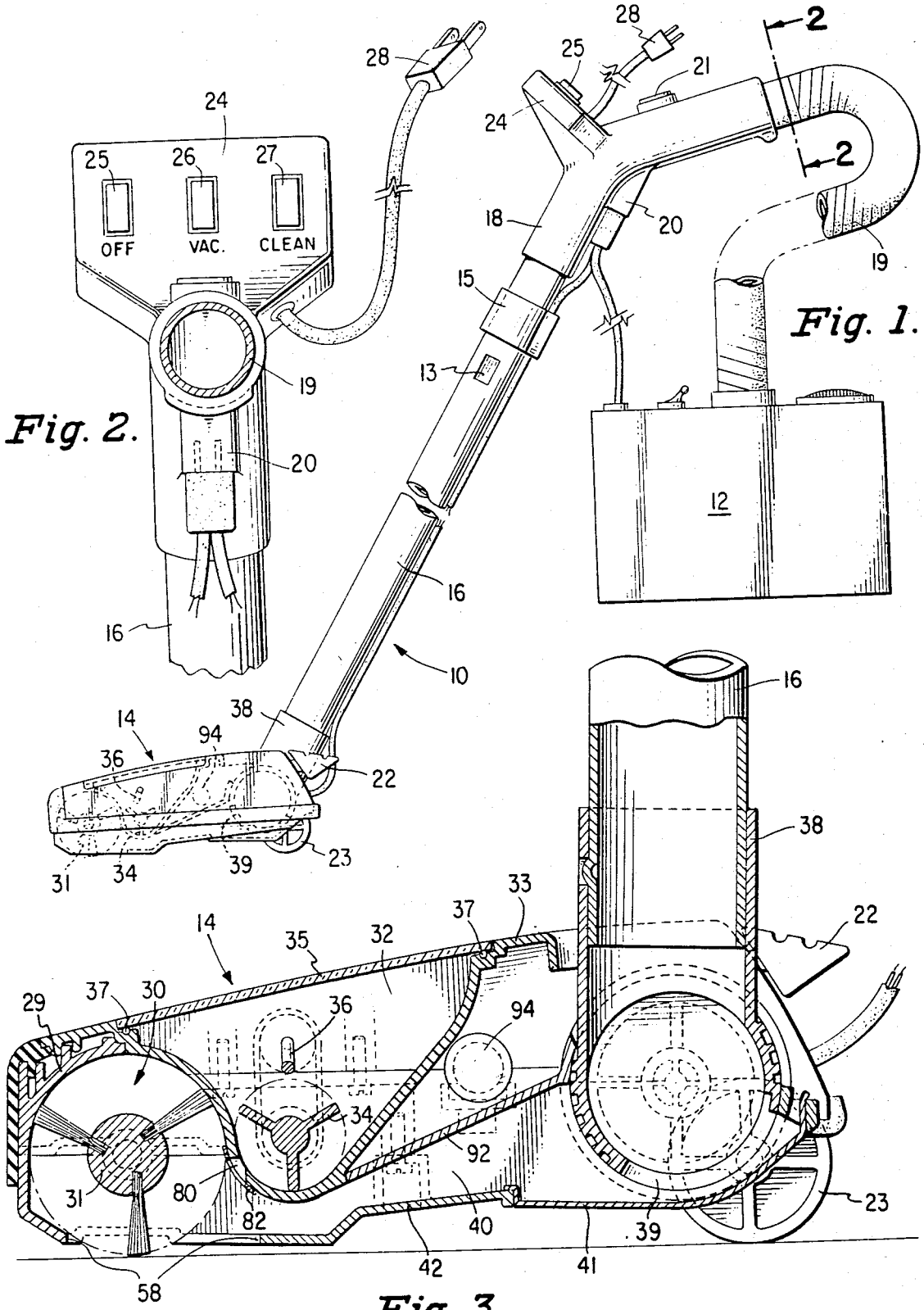
FIG. 1 is a left side elevation of the power head device of the invention.
FIG. 2 is a view taken along line 2—2 of FIG. 1 to show the controls for power head and the connections for power and vacuum.
FIG. 3 is an enlarged side elevation of the power head shown in FIG. 1 and in cross section to show the various chambers therein.

Referring to FIG. 1, there is disclosed a power head unit 10 shown connected to an external vacuum source 12 which might be a canister or tank type vacuum cleaner, or a convertible upright vacuum cleaner, or part of a central home vacuum system. The power head unit 10 includes a power head 14 which will be further described below, a wand 16 including a power cord extending upwardly from the power head to a control handle 18 supported on the upper end of the wand. As indicated above, the control handle 18 is adapted to receive a tubular connection 19 from any of a variety of extenal vacuum sources. The wand 16 and control handle 18 are shown in a use position, to which they may be displaced from an upright rest position by operator depression of pedal 22 on the power head 14 by means of any of many well known devices in the floor care art. The rear of the power head 14 is supported on a pair of rear wheels 23. Further visible in FIG. 1, the control handle 18 includes a receptacle 20 from which the external vacuum source may obtain a power connection, and a spring loaded slide switch 21 which will be used, as will be explained below, for the dispensing of a dry chemical carpet cleaning material (powder) on the carpet to be cleaned. The control handle 18 further includes a pedestal 24 supporting thereon switches only one 25 of which is visible.

By reference to FIG. 2, further features of the control handle 18 become apparent. In FIG. 2 there is visible the receptacle 20 which may be provided for the power connection of an external vacuum source. The switch 25 visible in FIG. 1, is seen to be an ON/OFF switch by which power to the power head 14 and the external vacuum source may be cut off to facilitate, for example, the initial connection of the power head unit 10 to a source of power. The switch 26 marked VAC may be depressed to initiate operation of the external source of vacuum and certain operations of the power head 14 which will be more fully explained below. Similarly, depression of the switch button 27 may be effective to shut off operation of the external source of vacuum in this configuration, and to initiate certain other operations of the power head 14 as will be more fully explained below. In the event that the receptacle 20 of the control handle 18 is not used for the external vacuum source, the external vacuum system may be shut off by means of its own control, or a collar 15 may be provided on the wand 16 which may be shifted as shown to expose a vacuum spoiling orifice 13. A power line 28 is provided as a source of power for the external source of vacuum through the receptacle 20, and for the power head 14 through the power cord of wand 16.

Referring now to FIG. 3, the power head 14 of FIG. 1 is shown enlarged and cross sectioned to disclose the various chambers therein. In the forward portion of the power head 14 there is located a brush chamber 30 implemented by a brush housing 29 in which is situated a brush 31 having, in this embodiment, three bristles. Immediately adjacent the brush chamber 30 is located a powder retaining chamber 32 implemented by an upper housing 33 and for receiving the powder, a dry chemical carpet cleaning material which may be a synthetic polymer formulated into sponge like porous particles and carrying a cleaning agent for a moisture content of approximately 40% to facilitate release of dirt particles from the carpet fibers. Such a dry chemical carpet cleaning material is known to agglomerate or cohere together in clumps, requiring some means to break up these clumps to facilitate dispensing of the same. For this purpose, a powder dispensing roll 34 is provided at the bottom of the powder retaining chamber 32, which roll may be implemented by a foam roller having open pores in intimate contact with the walls of the powder retaining chamber 32, or, as in this case, by a three bladed revolving member as shown. To further break up agglomerations or clumps, a revolving agitator rod 36 may be provided which is powered by a belt connection to the powder dispensing roll 34. A cover 35 is provided for the powder retaining chamber 32, through which cover the powder supply might be replenished as necessary. The cover 35, and other apertures to the powder retaining chamber 32 may be sealed by suitable gasketing material 37 in order to inhibit evaporation of the cleaning agent from the powder material stored in the chamber. Extending from the brush chamber 30 beneath the powder chamber 32 and into a swivel 38 connecting, through aperture 39, the power head 14 with the wand 16, is a vacuum chamber 40 implemented by lower housing 42 and swivel retainer and support 92. The vacuum chamber 40 is discontinuous beneath the brush 30 and slightly rearwardly thereof to provide access for dirt laden air to the vacuum chamber and to allow powder to be dispensed from the powder retaining chamber 32 to a carpet. An access port 41 is provided through which large ingested objects may be removed, if necessary. The power head 14 is supported on the brush 31 and on rear wheels 23, which revolve freely on an operator's urging of the power head 14. The brush 31 revolves counterclockwise as viewed in FIG. 3, in a vacuum mode of operation, and dirt vibrated and brushed from the carpet fibers by the brush is directed by the air stream passing through the opening into the vacuum chamber 40 and through swivel 38 to wand 16. In a clean mode of operation, as indicated above, the external vacuum source is shut off, or is rendered ineffective by providing for the spoiling orifice 13 shown in FIG. 1 on the wand 16. The orifice 13 permits external air into the wand 16 to the external vacuum source 12 so that vacuum will not be provided in the vacuum chamber 40 during the cleaning mode of operation.

Figure 4:
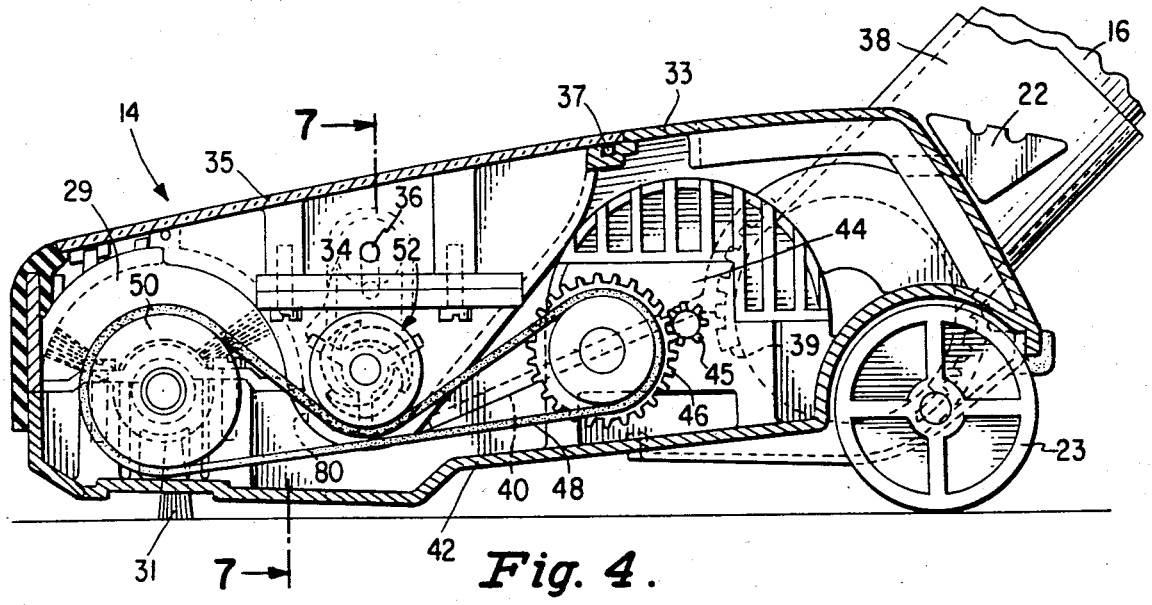
FIG. 4 is a side elevation of the power head in section to show one drive arrangement for the floor brush, powder dispensing roll and agitator.
Figure 5:
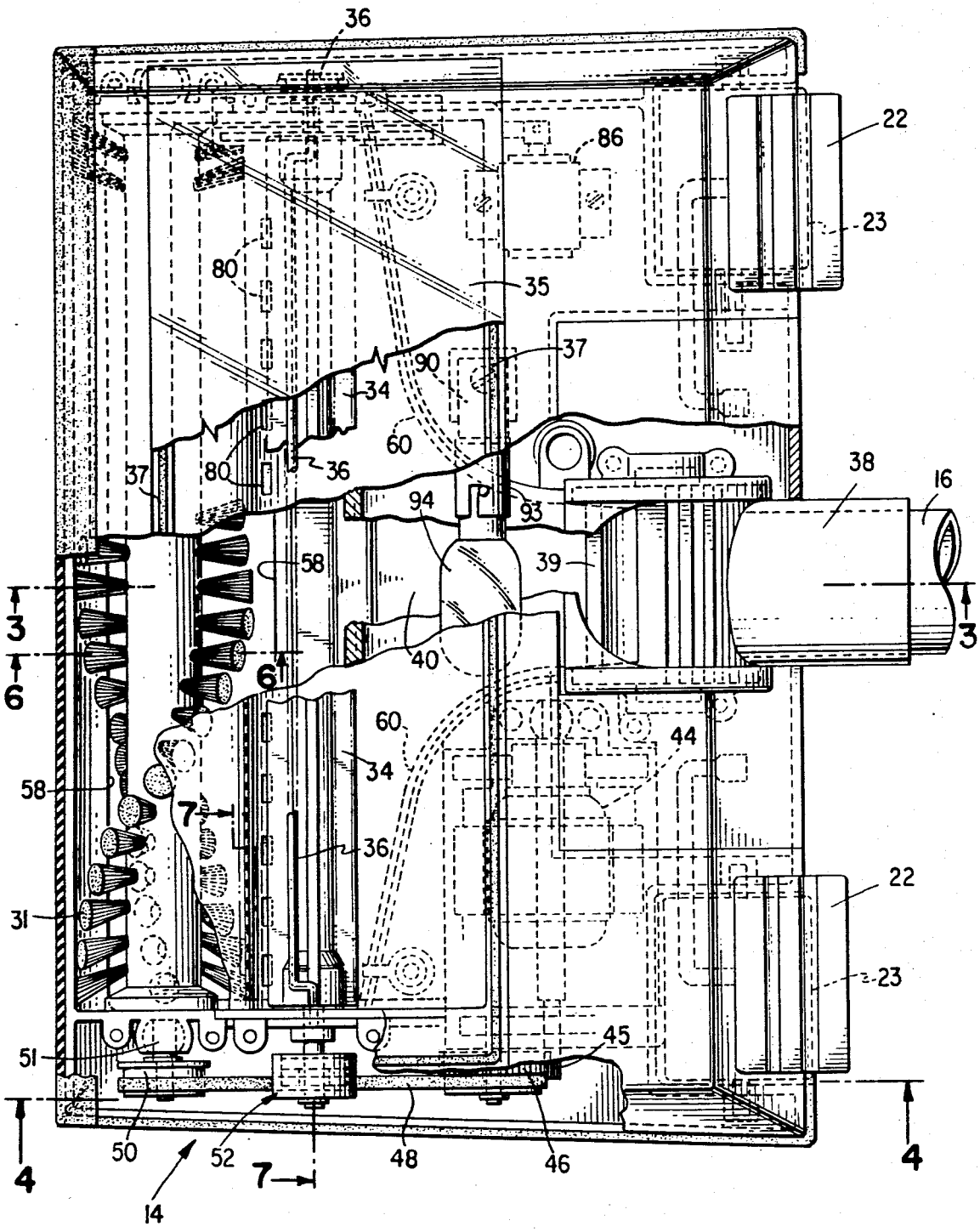
FIG. 5 is a top plan of the power head, partly broken away, to provide further details of the motor and drive arrangements.

In FIG. 4, there is disclosed an enlargement of the power head 14 shown in FIGS. 1 and 3 partly in section, however, in order to show the driving arrangement for the brush 31 and powder dispensing roll 34 and agitating rod 36. The lower housing 42 of the power head 14 supports therein a motor 44 fashioned with a pinion 45 on the output shaft thereof in meshing arrangement with gear-pulley 46 to obtain a step down of the motor RPM. A belt 48 extends between the pulley portion of the gear-pulley 46 and a pulley 50 mounted on the brush 31. The outside of the belt 48 extends about a one way clutch 52 supported on the end of the powder dispensing roll 34 so that the powder dispensing roll is not driven when the brush 31 is operating in the vacuum mode or counterclockwise as viewed in FIG. 4, but the powder dispensing roll is driven by the one way clutch when the motor 44 is reversed to drive the brush 31 in a clockwise direction as viewed in FIG. 4. Referring to FIG. 5, there is shown a plan view partly in section of the power head 14 in which the drive arrangement is also disclosed. In FIG. 5 is disclosed the motor 44 nestled in the lower housing 42 and retained thereto by screws. The pinion 45 in the end of the motor shaft is shown in mesh with the gear of gearpulley 46. Belt 48 extends from the gear pulley 46 to the pulley 50 on the brush 31. Also disclosed, is one of the two swivel bearings 51 supporting the brush 31. Apparent in this view, is the opening 58 through which the brush 51 extends and through which air streams into the vacuum chamber 40. The wall 60 of the vacuum chamber 40, as shown, curves about from both sides to converge on the swivel 38 from which air flows into the wand 16. A light bracket 90 extends from the swivel retainer 92 which forms the upper surface of the vacuum chamber 40 (see also FIG. 3) and supports thereon a fixture 93 for light bulb 94 which is situated between the vacuum chamber and the powder retaining chamber 32 (see FIG. 3). The light bulb 94 is activated only during the cleaning mode of operation and provides an operator with an indication of the amount of powder remaining in the powder retaining chamber 38 as viewed through translucent plastic material of the chamber 38 and cover 33.

Figure 6A:
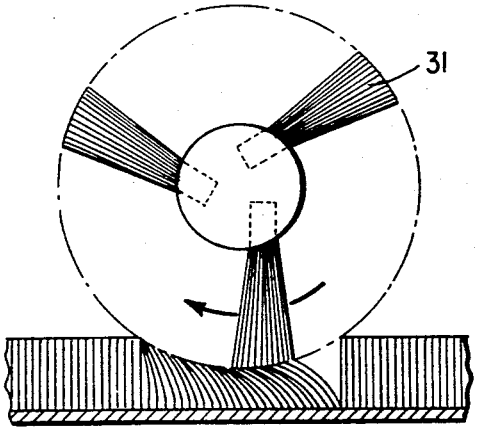
FIGS. 6*a* and *b* are cross sections of the floor brush taken substantially along the line 6—6 of FIG. 5 and showing the brush in different directions of rotation.
Figure 6B:
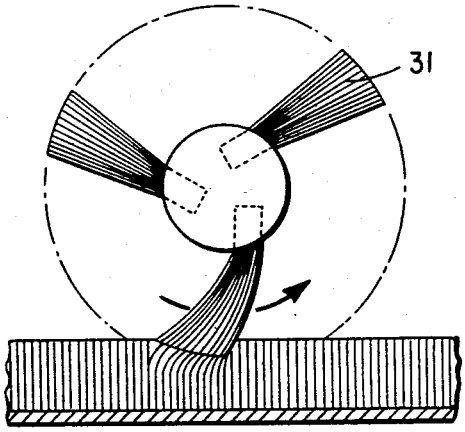

Referring to FIGS. 6*a* and *b*, there are shown a cross section of the brush 31 taken along line 6—6 of FIG. 5. The direction of rotation indicated in FIG. 6*a*, is the direction in which the brush 31 rotates when operating in the vacuum mode of operation. It can be seen that the bristles 62 of the brush 31 are offset from the diameter of the brush so that the bristles 62 thereof work more with carpet fibers when revolved in the clockwise direction shown in FIG. 6*b* in the cleaning mode of operation than in the counterclockwise direction shows in FIG. 6*a* indicated for the vacuum mode of operation. The effect of offsetting the bristles 62 of the brush 31 in this fasion is to stiffen the bristles so as to part the carpet fibers as indicated in FIG. 6*b*, and to permit the powder dispensed from the powder chamber 32 immediately adjacent the brush chamber 31 to be worked into the carpet fibers for intimate contact with deep portions of the fiber to remove dirt and stains thereon by the cleaning agent, and suspension thereof in the porous particles of the powder material.

Figure 7:
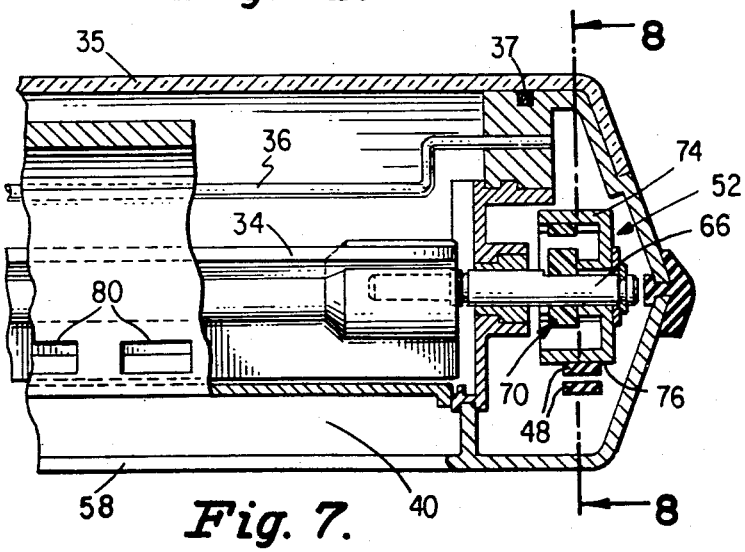
FIG. 7 is a cross section of the powder retaining chamber and clutch taken substantially along the line 7—7 of FIG. 5.
Figure 8:
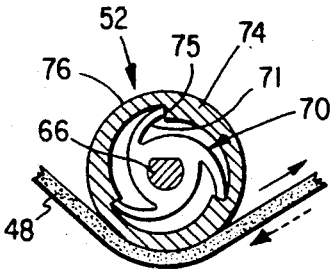
FIG. 8 is a cross section taken substantially along line 8—8 of FIG. 7.
Figure 9:
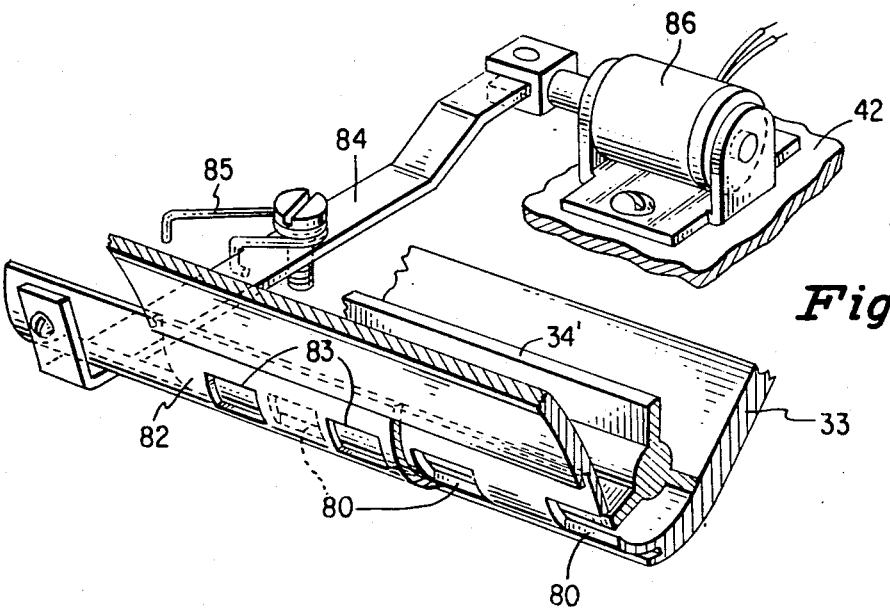
FIG. 9 is a broken away perspective view showing the arrangement provided for releasing the powder cleaning material onto the carpet surface.

In FIG. 7, there is shown a cross section of the one way clutch 52 taken substantially along the line 7—7 of FIG. 5. The connection to the powder dispensing roll 34 is by way of a slabbed shaft 66 which extends into the D-shaped opening therefor in an inner clutch 70. The inner clutch 70 includes fingers 71 extending counterclockwise from the central core thereof (see FIG. 8). The inner clutch 70 is situated internally of an outer clutch 74. The outer clutch 74 is formed with abutments 75 tapering off in a clockwise direction to a larger inside diameter. The outer clutch 74 has its outer diameter 76 in driving contact with the outside of belt 48 so that the outer clutch revolves whenever the motor 44 is activated. When the motor revolves to drive the brush 31 through the belt 48 in the counterclockwise direction shown in FIGS. 4 and 6*a*, the outer clutch 74 through its contact with the outer belt periphery is driven in a clockwise direction, and the fingers 71 of the inner clutch 70 resiliently yield to snap over the abutments 75, and there is little or no driving of the powder dispensing roll 34. However, if the motor 44 is reversed and the belt 48 drives the brush 31 in a clockwise direction as viewed in FIG. 6*b*, the outer clutch 74 of the one way clutch 52 is driven in a counterclockwise direction and the abutments 75 of the outer clutch engage with the ends of fingers 71 of the inner clutch 70 to drive it and the powder dispensing roll 34 in a counterclockwise direction. The powder dispensing roll 34 revolves in the powder chamber 32, breaking up agglomerations thereof, and conveying the powder to slots 80 in the lower housing 42, which slots are visible in FIGS. 4, 5 and 7. FIG. 9 shows a sliding door member 82 with apertures 83, which door member may be actuated by means of lever 84 as urged by solenoid 86 to overlap the apertures with the slots to uncover the slots. Torsion spring 85 biases the sliding door member 82, and the solenoid 86, to a position with the slots 80 covered by the door member. Solenoid 86 is supported on the lower housing 42 and is also visible in FIGS. 5, 10 and 11. Thus, the powder dispensing roll 34 may be revolved in the powder chamber 32 in order to break up any agglomerations in the powder therein, but the powder cleaning material is itself not dispensed from the slots 80 unless the sliding door 82 has been actuated by the lever 84 whenever the solenoid 86 is activated by means of the slide switch 21 in the control handle 18.

Figure 10:
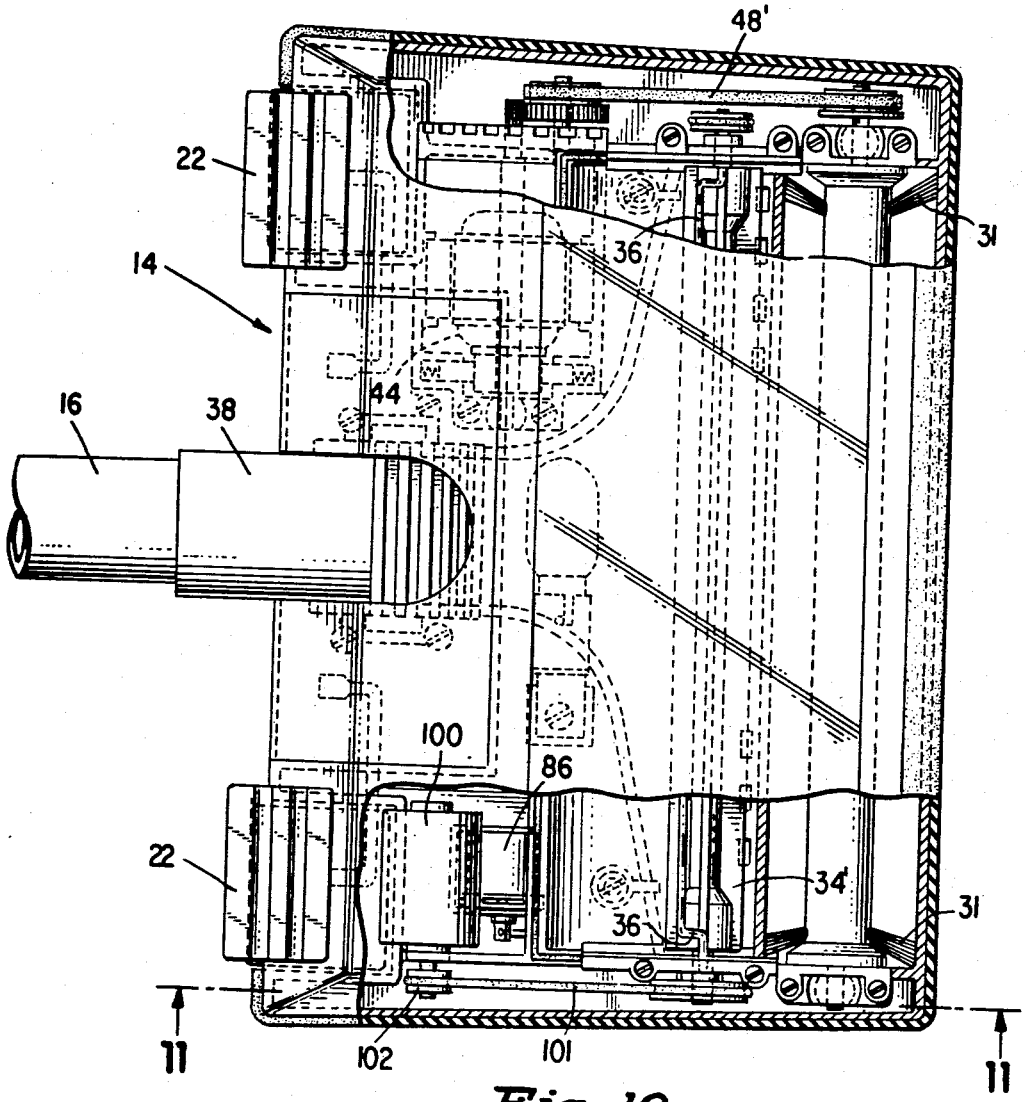
FIG. 10 is a top plan of another embodiment of the power head partially broken away and similar to FIG. 5 to shown the mounting of a second motor for the powder dispensing roll of the powder retaining chamber.
Figure 11:
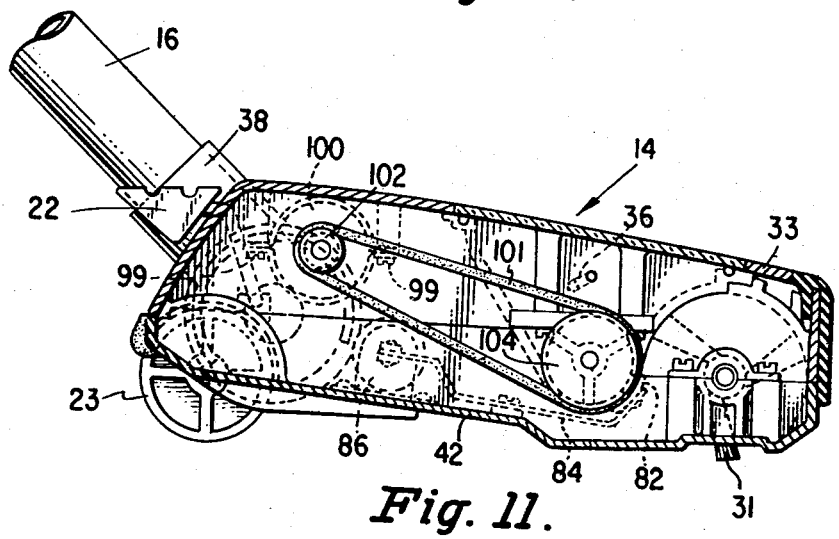
FIG. 11 is a right side elevation in section of the power head to show the connection of the second motor to the powder dispensing roll.

FIG. 10 is a top plan view partially broken away of another embodiment of a power head 14 in which a pair of motors are utilized. As shown in FIG. 5, a motor 44 is used to drive the brush 31 through a belt 48', but in this case, a second motor 100 is supported in the power head 14 on the upper housing 33 thereof, which motor is connected to the powder dispensing roll 34' by belt 101. When the cleaning mode of operation is selected by actuation of button 27 on the pedestal 24, and the slide switch 21 is activated, the second motor 100 is activated, together with the motor 44 which is activated in the reverse direction to reverse the direction of brush 31. The one way clutch 52 is not utilized to drive the powder dispensing roll 32 and the belt 48' extends between the gear-pulley 46 and the pulley 50 for the brush 31. In FIG. 11 is shown the mounting of the motor 100 on the upper housing 33 by means of screws 99. The belt 101 extends between pulley 102 affixed to the motor shaft and pulley 104 affixed to the powder dispensing roll 32'.

Figure 12:
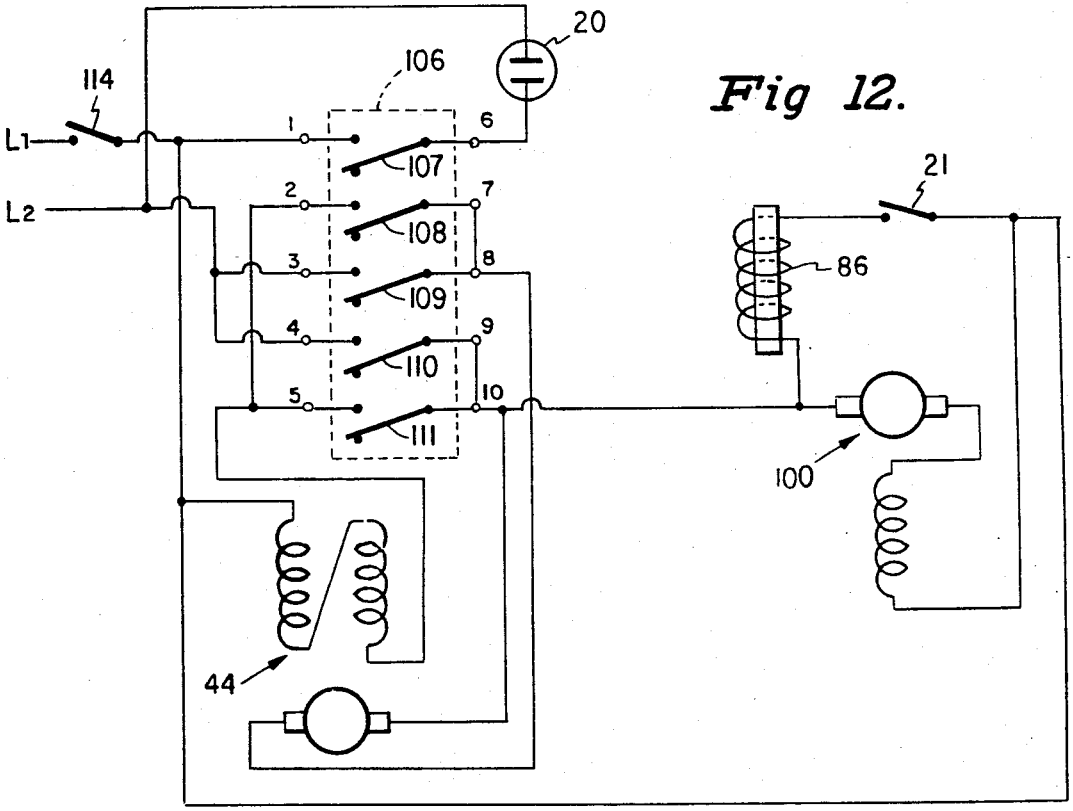
FIG. 12 is a typical wiring diagram of the power head device for the embodiment shown in FIGS. 10 and 11.

In FIG. 12 is a circuit diagram which might be used with the embodiment of the power head 14 disclosed in FIGS. 10 and 11. In FIG. 12, the 120 volt AC incoming line has line L1 connected to switch 114 which is implemented by button 25 on pedestal 24. The switch 114 is connected to terminal 1 of a push button switch unit 106 which includes five single pole, single throw switches, 107–111, which are actuated as described below. The other leg of the incoming 120 volt AC line is connected to terminals 3 and 4 of the push button switch 106. Terminals 2 and 5 of the switch unit 106 are connected together and to one end of the field of the brush motor 44. The other end of the field of the brush motor 44 is connected to terminal 1 of the switch unit 106 or to one leg of the 120 volt AC line. The armature of the brush motor 44 is connected to terminals 8 and 10 of the switch unit 106, and terminals 8 and 10 are connected to terminals 7 and 9, respectively. Terminal 6 of the switch unit 106 is connected one side of receptacle 20 in the control handle 18. The other side of the receptacle 20 is connected to line L2 of the incoming 120 volt AC line. As indicated above, receptacle 20 is provided for connection of an external vacuum source to the power head unit 10, which external vacuum source would then be responsive to the manipulation of the push button switch unit 106 on the control handle 18.

One side of the armature of the solenoid 86 and the second motor 100 used to rotate the powder dispensing roll 34' in the embodiment disclosed in FIGS. 10 and 11, is connected to terminal 10 of the switch unit 106. The other side of the armature is connected to the field for the second motor 100 which is then connected to one side of the slide switch 21 for actuating the sliding door member 82. The slide switch 21 is the control handle 18 then connects to the other side of the solenoid 86. Line L1 of the incoming 120 volt AC line is connected to the switch 21 and to the field of the second motor 100.

In operation, when the vac switch push button 26 in the control handle 18 is depressed, the switches 107, 109, 111 and 114 are closed to provide power and connections between terminals 1 and 6, 3 and 8, and 5 and 10. Thus, the external source of vacuum is activated through the receptacle 20 and line 1 of the 120 volt AC line is connected to one end of the field of the brush motor 44 which is connected to the armature thereof through terminals 5, 10, the armature being connected to line 2 through terminals 3, 8. If a clean mode of operation is selected by depression of the clean switch button 27, the switches 108, 110 and 114 are closed to provide power and a connection between terminals 2 and 7 between terminals 4 and 9. In this event, no power is supplied to the receptacle 20, and the external source of vacuum is not effective. Line 1 of the 120 volt AC line is connected as before to one end of the field of the brush motor 44, however, the armature thereof is reversed so that the direction of the brush motor is reversed. A connection between terminals 4 and 9 of the switch unit 106 provided a potential on terminal 10 which will activate the second motor 100 and solenoid 86 when the slide switch 21 in the control handle is manipulated. In this event, the powder dispensing roll 34' is revolved by the second motor 100 and the sliding door 82 is shifted by the solenoid 86 to expose the slots 80 in the lower housing 42 to dispense the powder on the carpet for operation thereupon by the brush 31. Depression of the OFF switch button 25 (switch 114) opens the switches 107 through 111 as shown in FIG. 12, in which case no operation takes place.

While the invention has been described, disclosed, illustrated and shown in terms of preferred embodiments or modifications, such other embodiments or modifications as may be suggested to those having the benefit of the teachings herein are intended to be reserved, especially as they fall within the scope and breadth of the claims herein appended.

We claim:

1. For use with an external source of vacuum, a power head unit for a carpet cleaner and vacuum, said power head unit comprising:

a housing;

means for connecting said housing to said external source of vacuum;

means in said housing for defining a brush chamber, a vacuum chamber for communication on one end with said brush chamber and on the other end with said connecting means, and a powder retaining chamber for retaining a quantity of a dry chemical carpet cleaning material therein;

a brush rotatably supported in said brush chamber said brush further comprising bristles and a substantially circular brush roll supporting said bristles offset from the centerline of said brush roll so that in a first direction of rotation said bristles resiliently sweep over said carpet toward said vacuum chamber with a first force and in a second direction of rotation said bristles resiliently sweep against said carpet with a second force higher than said first force for agitating dry chemical carpet cleaning materials into said carpet to perform a cleaning function;

means for selectively reversibly rotating said brush;

said housing further supporting means for selectively dispensing said dry chemical carpet cleaning material onto said carpet, said means including at least one slot in said powder retaining chamber adjacent said brush chamber and extending therealong, means for selectively covering said at least one slot, and means in said powder retaining chamber adjacent said at least one slot for facilitating dispensing of said dry chemical cleaning material through said at least one slot when said covering means is actuated to uncover said at least one slot.

2. A power head unit as claimed in claim 1 wherein said covering means further comprises a door member slidable externally of said powder retaining chamber in covering relationship to said at least one slot, said door member having at least one aperture corresponding in size to said at least one slot, and means for selectively sliding said door member to obtain correspondence between said at least one slot and said at least one aperture.

3. A power head unit as claimed in claim 2 wherein said sliding means further comprises a solenoid supported within said housing, and a lever extending between said solenoid and said door member whereby activating said solenoid slides said door member into a position in which said at least one slot and said at least one aperture are in correspondence.

4. A power head unit as claimed in claim 3 wherein said dispensing means further comprises:

a powder dispensing roll rotatably supported in said powder retaining chamber, said powder dispensing roll including a central mandril supporting at least radially extending blade terminating at a distance sufficient to pass immediately adjacent said at least one slot when said roll is rotating so as to facilitate the dispensing of said dry chemical carpet cleaning material; and means for selectively implementing rotation of said powder dispensing roll.

5. A power head unit as claimed in claim 4 further comprising:

a wire form rotatably connected to said powder dispensing roll and having an eccentric portion extending through said powder retaining chamber, whereby agglomeration of said dry chemical carpet cleaning material in said powder retaining chamber may be broken up prior to pick up by said powder dispensing roll so as to facilitate the delivery of said carpet cleaning material through said at least one slot.

6. A power head unit as claimed in claim 5 or 1 further comprising:

means for selecting a vacuum mode of operation in which said brush rotates in said first direction toward said vacuum chamber or a cleaning mode of operation in which said brush rotates in said second direction away from said vacuum chamber.

7. A power head unit as claimed in claim 6 wherein said housing is formed of a translucent material and further comprises:

a light source situated adjacent said powder retaining chamber, said light source being activated in said cleaning mode of operation so as to facilitate the determination of the quantity of powder remaining in said powder retaining chamber.

8. A power head unit as claimed in claim 6 further comprising:

means effective for removing vacuum from said vacuum chamber.

9. A power head unit as claimed in claim 6 further comprising means effective for removing vacuum from said vacuum chamber, and wherein said selecting means in said cleaning mode of operation actuates said removing means.

10. A power head unit as claimed in claim 4 wherein said means for selectively reversibly rotating said brush further comprises:

a selectively reversible electric motor having an output shaft, a first pulley supported on said output shaft, a second pulley connected with said brush roll, and a belt connecting said first pulley and said second pulley; said powder dispensing means further comprising a one way clutch supported on said powder dispensing roll and connected to said belt to inhibit rotation of said powder dispensing roll when said brush rotates in said first direction and to initiate rotation of said powder dispensing roll when said brush rotates in said second direction of rotation.

11. A power head unit as claimed in claim 10 further comprising:

means for selectively revolving said powder dispensing roll in a direction to facilitate the dispensing of said dry chemical carpet cleaning material through said at least one slot, means for operator selecting of a vacuum mode of operation in which said brush rotates in said first direction towards said vacuum chamber or a cleaning mode of operation in which said brush rotates in said second direction away from said vacuum chamber; and means effective in said cleaning mode of operation for implementing operator selected activation of said revolving means and said sliding means so as to dispense dry chemical carpet cleaning material on said carpet for agitation therein by said brush rotating in said second direction to perform said cleaning function thereon.

12. For use with an external source of vacuum, a power head unit for a carpet cleaner and vacuum, said power head unit comprising:

a housing;

means including an upwardly extending wand for connecting said housing to said external source of vacuum;

means in said housing for defining a brush chamber, a vacuum chamber for communication on one end with said brush chamber and on the other end with said connecting means, and a powder retaining chamber for retaining a quantity of a dry chemical carpet cleaning material therein;

a brush rotatably supported by said housing for contact with a carpet, said brush comprising bristles and a substantially circular brush roll supporting said bristles offset from the centerline of said brush roll so that in a first direction of rotation said bristles resiliently sweep over said carpet toward said vacuum chamber with a first force and in a second direction of rotation said bristles resiliently sweep against said carpet with a second force higher than said first force for agitating dry chemical carpet cleaning material into said carpet to perform a cleaning function;

means for selectively reversibly rotating said brush;

said housing further supporting means for selectively dispensing said dry chemical cleaning material onto said carpet;

means supported by said wand for selecting between a vacuum mode of operation and a carpet cleaning mode of operation in which said dispensing means is selectively effective;

a least one slot in said powder retaining chamber adjacent said brush chamber and extending therealong;

means for selectively covering said at least one slot;

means on said powder retaining chamber adjacent said at least one slot for facilitating dispensing of said dry chemical cleaning material through said at least one slot when said covering means is actuated to uncover said at least one slot.

13. A power head unit as claimed in claim 12 wherein said covering means further comprises a door member slidable externally of said powder retaining chamber in covering relationship to said at least one slot, said door member having at least one aperture corresponding in size to said at least one slot, and means for selectively sliding said door member to obtain correspondence between said at least one slot and said at least one aperture.

14. A power head unit as claimed in claim 13 wherein said sliding means further comprises a solenoid supported within said housing, and a lever extending between said solenoid and said door member whereby activating said solenoid slides said door member into a position into which said at least one slot and said at least one aperture are in correspondence.

15. A power head unit as claimed in claim 14 wherein said dispensing means further comprises:

a powder dispensing roll rotatably supported in said powder retaining chamber, said powder dispensing roll including a central mandril supporting at least one radially extending blade terminating at a distance sufficient to pass immediately adjacent said at least one slot when said roll is rotating so as to facilitate the dispensing of said dry chemical carpet cleaning material; and, means for selectively implementing rotation of said powder dispensing roll.

16. A power head unit as claimed in claim 15 wherein said dispensing means further comprises:

a wire form having an eccentric portion extending through said powder retaining chamber and connected to said powder dispensing roll for rotation therewith, whereby said eccentric portion of said wire form rotates in said powder retaining chamber to break up agglomerations of said dry chemical carpet cleaning material to facilitate delivery of the same to said powder dispensing roll and through said at least one slot.

17. A power head unit as claimed in claim 16 or 12 wherein selection by said selecting means of a vacuum mode of operation initiates brush rotation in said first direction toward said vacuum chamber and selection by said selecting means of a carpet cleaning mode of operation initiates brush rotation in said second direction away from said vacuum chamber.

18. A power head unit as claimed in claim 17 further comprising means effective for removing vacuum from said vacuum chamber, and wherein said selecting means in said cleaning mode of operation actuates said removing means.

19. A power head unit as claimed in claim 17 further comprising means effective for removing vacuum from said vacuum chamber.

20. For use with an external source of vacuum, a power head unit for a carpet cleaner and vacuum, said power head unit comprising:

a housing;

means for connecting said housing to said external source of vacuum;

means in said housing for defining a brush chamber, a vacuum chamber for communication on one end with said brush chamber and on the other end with said connecting means, and a powder retaining chamber for retaining a quantity of a dry chemical carpet cleaning material therein;

a brush rotatably supported in said brush chamber for contact with a carpet, said brush further comprising bristles and a substantially circular brush roll supporting said bristles offset from the centerline of said brush roll so that in a first direction of rotation said bristles resiliently sweep over said carpet towards said vacuum chamber with a first force and in a second direction of rotation said bristles resiliently sweep against said carpet with a second force higher than said first force for agitating dry chemical carpet cleaning material into said carpet to perform a cleaning function;

means for selectively reversibly rotating said brush;

said housing further supporting means for selectively dispensing said dry chemical carpet cleaning material onto said carpet;

means for selecting a vacuum mode of operation in which said brush rotates in said first direction toward said vacuum chamber or a cleaning mode of operation in which said brush rotates in said second direction away from said vacuum chamber; and, means effective for removing vacuum from vacuum chamber, wherein said selecting means in said cleaning mode of operation actuates said removing means.

21. For use with an external source of vacuum, a power head unit for a carpet cleaner and vacuum, said power head unit comprising:

a housing;

means for connecting said housing to said external source of vacuum;

means in said housing for defining a brush chamber, a vacuum chamber for communication on one end with said brush chamber and on the other end with said connecting means, and a powder retaining chamber for retaining a quantity of a dry chemical carpet cleaning material therein;

a brush rotatably supported in said brush chamber for contact with a carpet, said brush further comprising bristles and a substantially circular brush roll supporting said bristles offset from the centerline of said brush roll so that in a first direction of rotation said bristles resiliently sweep over said carpet towards said vacuum chamber with a first force and in a second direction of rotation said bristles resiliently sweep against said carpet with a second force higher than the first force for agitating dry chemical carpet cleaning material into said carpet to perform a cleaning function;

means for selectively reversibly rotating said brush;

said housing further supporting means for selectively dispensing said dry chemical carpet cleaning material onto said carpet;

means for selecting a vacuum mode of operation in which said brush rotates in said first direction towards said vacuum chamber or a cleaning mode of operation in which said brush rotates in said second direction away from said vacuum chamber; and, means effective for removing vacuum from said vacuum chamber.

22. For use with an external source of vacuum, a power head unit for a carpet cleaner and vacuum, said power head unit comprising:

a housing;

means including an upwardly extending wand for connecting said housing to said external source of vacuum;

means in said housing for defining a brush chamber, a vacuum chamber for communication on one end with said brush chamber and on the other and with said connecting means, and a powder retaining chamber for retaining a quantity of a dry chemical carpet cleaning material therein;

a brush rotatably supported in said brush chamber for contact with the carpet, said brush further comprising bristles and a substantially circular brush roll supporting said bristles offset from the centerline of said brush roll so that in a first direction of rotation said bristles resiliently sweep over said carpet towards said vacuum chamber with a first force and in a second direction of rotation said bristles resiliently sweep against said carpet with a second force higher than said first force for agitating dry chemical carpet cleaning material into said carpet to perform a cleaning function;

means for selectively reversibly rotating said brush;

said housing further supporting means for selectively dispensing said dry chemical cleaning material onto said carpet;

means supported by said wand for selecting between a vacuum mode of operation and a carpet cleaning mode of operation in which said dispensing means is selectively effective; and, means effective for removing vacuum from said vacuum chamber, wherein said selecting means in said cleaning mode of operation actuates said removing means.

23. For use with an external source of vacuum, a power head unit for a carpet cleaner and vacuum, said power head unit comprising:

a housing;

means including an upwardly extending wand for connecting said housing to its said external source of vacuum;

means in said housing for defining a brush chamber, a vacuum chamber for communication on one end with said brush chamber and on the other end with said connecting means, and a powder retaining chamber for retaining a quantity of a dry chemical carpet cleaning material therein;

a brush rotatably supported in said brush chamber for contact with the carpet, said brush further comprising bristles and a substantially circular brush roll supporting said bristles offset from the centerline of said brush roll so that in a first direction of rotation said bristles resiliently sweep over said carpet toward said vacuum chamber with a first force and in a second direction of rotation said bristles resiliently sweep against said carpet with a second force higher than said first force for agitating dry chemical carpet cleaning material into said carpet to perform a cleaning function;

means for selectively reversibly rotating said brush;

said housing further supporting means for selectively dispensing said dry chemical cleaning material onto said carpet;

means supported by said wand for selecting between a vacuum mode of operation and a carpet cleaning mode of operation in which said dispensing means is selectively effective; and, means effective for removing vacuum from said vacuum chamber.

24. For use with an external source of vacuum, a power head unit for a carpet cleaner and vacuum, said power unit comprising:

a housing;

means including an upwardly extending wand for connecting said housing to said external source of vacuum;

means in said housing for defining a brush chamber, a vacuum chamber for communication on one end with said brush chamber and on the other end with said connecting means, and a powder retaining chamber for retaining a quantity of a dry chemical carpet cleaning material therein;

a brush rotatably supported in said brush chamber for contact with the carpet, said brush further comprising bristles and a substantially circular brush roll supporting said bristles offset from the centerline of said brush roll so that in a first direction of rotation said bristles resiliently sweep over said carpet toward said vacuum chamber with a first force and in a second direction of rotation said bristles resiliently sweep against said carpet with a second force higher than said first force for agitating dry chemical carpet cleaning material into said carpet to perform a cleaning function;

means for selectively reversibly rotating said brush;

said housing further supporting means for selectively dispensing said dry chemical cleaning material onto said carpet;

means supported by said wand for selecting between a vacuum mode of operation and a carpet cleaning mode of operation in which said dispensing means is selectively effective; and, means effective for sealing said powder retaining chamber to inhibit escape of a liquid portion of the dry chemical carpet cleaning material therefrom.

* * * * *